United States Patent [19]

Schneider et al.

[11] 3,993,020

[45] Nov. 23, 1976

[54] BLADE APPLICATOR ASSEMBLY

[75] Inventors: John M. Schneider, Fairport; Herman A. Hermanson, Penfield; Christian O. Abreu, Rochester, all of N.Y.

[73] Assignee: Xerox Corporation, Stamford, Conn.

[22] Filed: May 16, 1975

[21] Appl. No.: 578,288

[52] U.S. Cl. ..... 118/407; 101/366; 118/261; 222/361; 355/10

[51] Int. Cl.[2] ..... B05C 3/02

[58] Field of Search ..... 355/3 P, 10, 4; 118/407, 413, 259, 258, 261, DIG. 23; 101/366; 222/361, 362; 96/1 PE, 1.3

[56] References Cited

UNITED STATES PATENTS

| | | | |
|---|---|---|---|
| 2,505,697 | 4/1950 | Vomacka | 222/361 |
| 3,192,895 | 7/1965 | Galer | 118/413 X |
| 3,623,639 | 11/1971 | McShirley | 222/361 X |
| 3,667,428 | 6/1972 | Smith | 118/DIG. 23 |
| 3,696,020 | 10/1972 | Carreira | 355/3 P |
| 3,703,459 | 11/1972 | Little et al. | 118/259 X |
| 3,800,743 | 4/1974 | Egnaczak | 118/259 |

*Primary Examiner*—R. L. Moses

*Attorney, Agent, or Firm*—James J. Ralabate; Michael H. Shanahan; Charles E. Smith

[57] ABSTRACT

A coating applicator system comprising a stationary coater blade, reciprocating valve and applicator plates and, interposed between the valve and applicator plates, a stationary metering plate which includes a metering cavity. In operation, a quantity of photoelectrophoretic imaging suspension is supplied to the metering cavity in the metering plate when the valve and applicator plates are cammed in. When the reciprocating plates are cammed out, a metered amount of the suspension is deposited on the coater blade and when the plates are cammed in the imaging suspension is caused to move into a coating gap to supply a uniform quantity of suspension to a surface to be coated.

4 Claims, 4 Drawing Figures

BLADE APPLICATOR ASSEMBLY

BACKGROUND OF THE INVENTION

This invention relates, in general, to coating applicator systems and, more particularly, their use in an improved photoelectrophoretic imaging system.

In the photoelectrophoretic imaging process, monochromatic including black and white or full color images, are formed through the use of photoelectrophoresis. An extensive and detailed description of the photoelectrophoretic process is found in U.S. Pat. Nos. 3,384,488 and 3,383,565, to Tulagin and Carreira; 3,383,993 to Yeh and 3,384,566 to Clark, which discloses a system where photoelectrophoretic particles migrate in image configuration providing a visible image at one or both of two electrodes between which the particles suspended within an insulating carrier is placed. The particles are electrically photosensitive and are believed to bear an electrical charge while suspended, which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic, depending upon whether the photosensitive particles within the liquid carrier are responsive to the same or different portions of the light spectrum. A full-color polychromatic system is obtained, for example, by using cyan, magenta and yellow colored particles which are responsive to red, green and blue light, respectively.

In photoelectrophoretic imaging generally, and as employed in the instant invention, the important broad teachings in the following four paragraphs should be noted.

Preferably, as taught in the four patents referred to above, the electric field across the imaging suspension is applied between electrodes having certain preferred properties, i.e., an injecting electrode and blocking electrode, and the exposure to activating radiation occurs simultaneously with field application. With respect to the application of the electrical field, it should be noted that various of the four patents referred to above and, additionally, Luebbe et al., U.S. Pat. No. 3,595,770; Keller et al., U.S. Pat. No. 3,647,659 and Carreira et al., U.S. Pat. No. 3,477,934 teach a wide variety of materials and techniques for associating an electrical bias with the materials, e.g., charged insulating webs. Accordingly, it should be understood that opposed electrodes generally may comprise the means for applying the electrical field across the imaging suspension. In preferred embodiments herein, one electrode is referred to as the injecting electrode and the other electrode as the blocking electrode. The terms injecting electrode and blocking electrode should be understood and interpreted in the context of the above comments throughout the specification and the claims.

It should also be noted that any suitable electrically photosensitive particles may be used. Kaprelian, U.S. Pat. No. 2,940,847 and Yeh, U.S. Pat. No. 3,681,064, disclose various electrically photosensitive particles, as do the four patents referred to above.

In a preferred mode, at least one of the electrodes is transparent. In this embodiment, the electrode may be completely or substantially completely transparent or it may be only partially transparent yet transmit enough activating radiation to allow photoelectrophoretic imaging to occur. In another embodiment, such as is described in Weigl, U.S. Pat. No. 3,616,390, both electrodes may be opaque.

In operation, preferably the injecting electrode is grounded and the blocking electrode is biased to provide the electrical field for imaging. However, it should be noted that a wide variety of variations in how the electrical field may be applied can be used. These include, for example, grounding the blocking electrode and biasing the injecting electrode; biasing both electrodes with different bias values of the same polarity; biasing one electrode at one polarity and biasing the other electrode at the opposite polarity of the same or different magnitude, etc. Generally, any suitable technique for establishing an electrical field across the imaging suspension may be used.

The electrode used in the photoelectrophoretic imaging system may be provided in a variety of configurations including flat plates, rollers, endless belts, etc.

SUMMARY OF THE INVENTION

Generally, in the above photoelectrophoretic imaging system, a uniform layer of imaging suspension or photoelectrophoretic ink has been applied to the surface of the transparent electrode by a donor drum or by an extruder type applicator.

There has been recently developed a photoelectrophoretic imaging system which utilizes web materials, which optimally may be disposable. In this process, the desired image, e.g., the photographic positive, is formed on one of the webs and another web will carry away the negative, typically unwanted image. The positive image can be fixed to the web upon which it is formed or the image transferred to a suitable backing such as paper. The web which carries the negative image can be rewound and later utilized or disposed of. In such photoelectrophoretic imaging systems employing disposable webs, cleaning systems are not required.

In photoelectrophoretic imaging systems employing the web device configuration, the inking system is required to deliver, apply and distribute a thin film of photoelectrophoretic ink comprising mineral oil base ink as a carrier for magenta, cyan and yellow pigments, onto the surface of a web material formed of Mylar with an aluminized substrate. The ink should be of a uniform thickness and must be applied to the web without tailing defects.

Accordingly, it is an object of this invention to provide a coater applicator system to deliver photoelectrophoretic ink to produce an ink film of uniform thickness in a prescribed rectangular area on a moving surface that may be a web.

It is another object of this invention to provide a coating applicator system adapted to supply photoelectrophoretic ink that is easily cleaned.

Another object of the present invention is to provide a coating applicator system suitable for intermittent operation.

Still another object of this invention is to provide a coating applicator system which may be either manually or automatically supplied with ink.

These and other objects and advantages are accomplished according to the present invention by providing a coating applicator system comprising a stationary coater blade, reciprocating valve and applicator plates and, interposed between the valve and applicator plates, a stationary metering plate which includes a metering cavity. In operation, a quantity of photoelectrophoretic imaging suspension is supplied to the metering cavity in the metering plate when the valve and applicator plates are cammed in. When the reciprocating plates are cammed out, a metered amount of the suspension is deposited on the coater blade and when the plates are cammed in, the imaging suspension is caused to move into a coating gap to supply a uniform quantity of suspension to a surface to be coated.

BRIEF DESCRIPTION OF THE DRAWINGS

For a better understanding of the invention as well as other objects and further features thereof, reference is made to the following detailed description of various preferred embodiments thereof, taken in conjunction with the accompanying drawings wherein.

DESCRIPTION OF THE PREFERRED EMBODIMENTS

The invention herein is described and illustrated in specific embodiments having specific components listed for carrying out the functions of the apparatus. Nevertheless, the invention need not be thought of as being confined to such specific showings and should be construed broadly within the scope of the claims. Any and all equivalent structures known to those skilled in the art can be substituted for specific apparatus disclosed as long as the substituted apparatus achieves a similar function. It may be that other methods and apparatus may be invented having similar needs to those fulfilled by the method and apparatus as described and claimed herein, and it is the intention herein to describe an invention for use in apparatus other than the embodiments shown.

Figure 1:
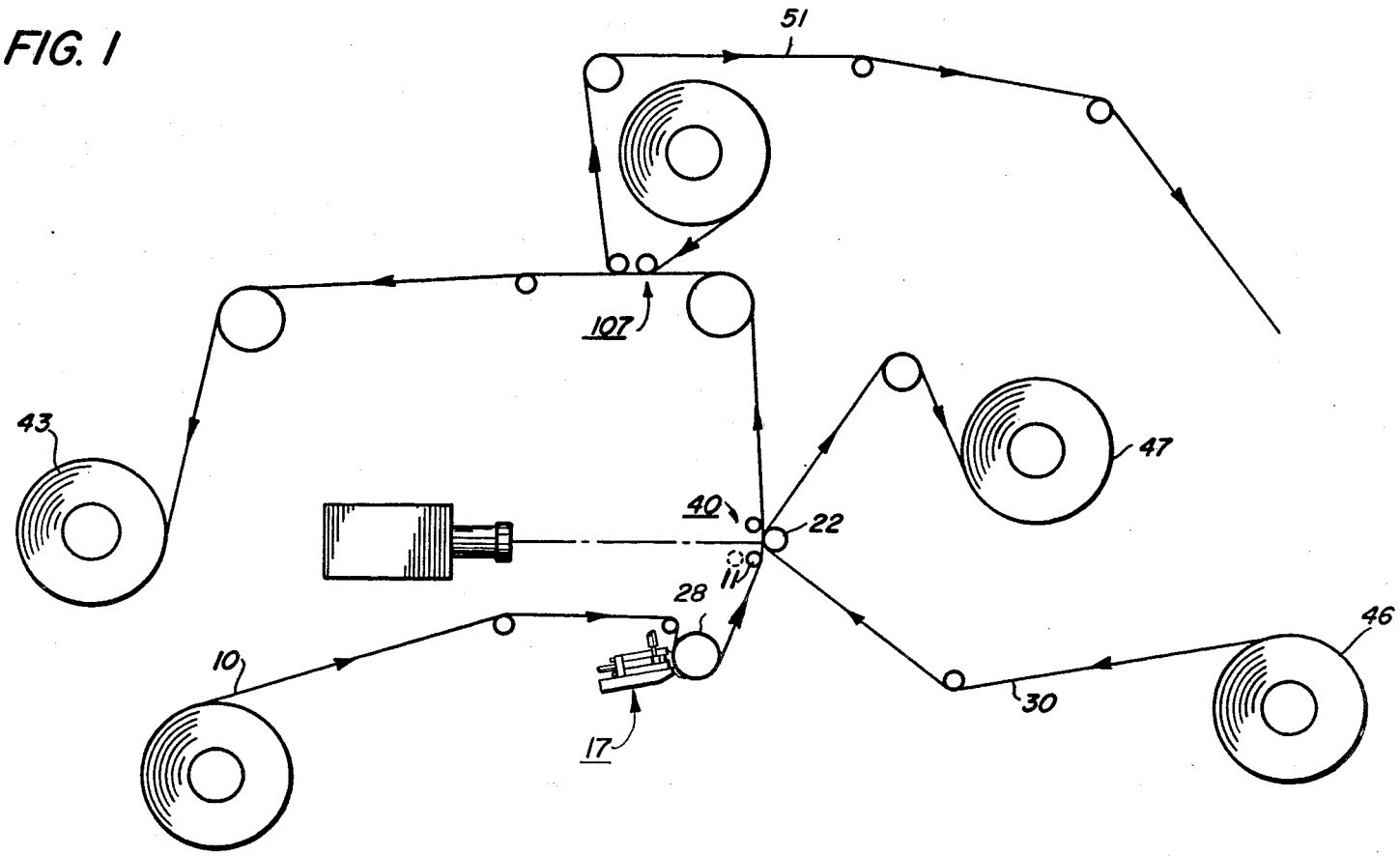
FIG. 1 is a partially schematic representation of the side view of a photoelectrophoretic imaging system employing a web device configuration comprising a coating applicator system.

Referring now to FIG. 1, there is seen a schematic diagram of a portion of a web device photoelectrophoretic imaging system comprising three webs. The web 30, referred to as the blocking web, is formed of an about 1 mil clear polypropylene blocking material. Web 10, referred to as the injecting web or conductive web, formed of an about 1 mil Mylar, a polyethylene terephethalate polyester film from DuPont, overcoated with a thin transparent conductive material, e.g., about 50% white light transmissive layer of aluminum. The conductive surface of the injecting web 10 is preferably connected to ground roll 11. As will be made clear from the explanation that will be given below by analogy, the functions of the injecting web 10 and blocking web 30 correspond to the functions of the injecting and blocking electrodes, respectively, described in greater detail in the four patents referenced earlier. The web device coating applicator, generally represented as 17, includes applicator plate 26, coater blade 27, valve plate 65, metering plate 67 including metering cavity 68 and backup inking roller 28 mounted for rotation. Imaging suspension is provided to the coating applicator through a tube 79 which is connected to a reservoir (not shown) such that the suspension is provided by gravity feed. The coating applicator 17 supplies a metered flow of ink that will provide a uniform ink coating of the desired thickness on the conductive side of the injecting web 10. In one exemplary instance, an approximately 14 inch film ink layer is coated onto the injecting web 10 at a thickness of about 1.25 mils with a tolerance of plus or minus 0.1 mil.

At the start of the photoelectrophoretic imaging process, the injecting web 10 is driven in the direction of the arrow by a mechanical drive, not shown, which accelerates the injecting web to a constant speed between 3 to 20 inches per second, preferably about 5 inches per second. Before the ink application cycle begins, the valve and applicator plates may be cammed out so that no ink is supplied to the metering cavity. Upon receiving a signal from the machine cam bank (not shown) the reciprocating plates are cammed in and a supply of ink is deposited in the metering cavity 68 through connector tube 79. The reciprocating plates are then cammed out and a metered amount of the ink is deposited on coater blade 27. The ink is then applied to the moving web 10 when the reciprocating plates are cammed back in.

Before the layer of ink film coated on the conductive web 10 reaches the imaging zone, generally designated as 40, the blocking web 30, driven from supply roll 46 in the direction of the arrow by independent drive, not shown, accelerates to a constant speed to match the speed of the injecting web 10. The two webs are brought together at the imaging zone 40 to form the ink web sandwich. The imaging roller 22, which may be formed, for example, of steel or conductive rubber, may be utilized to apply a uniform electrical imaging field across the ink web sandwich. During the period when the ink web sandwich is formed and simultaneously with the application of the imaging field, exposure to electromagnetic radiation is made through injecting web 10 to the ink web sandwich in the imaging zone. Upon completion of the imaging cycle, the webs separate and pass beyond the imaging areas between frames. The injecting web preferably carries the formed positive image whereas the blocking web 30 carries the negative image. The blocking web 30 is rewound on takeup reel 47 and may be used later or disposed of. The positive image formed on the surface of the injecting web 10 is carried to the transfer zone, generally represented as 107, into contact with a copy web 51 whereat the formed image is transferred to the copy web. After the transfer step, the injecting web and copy webs are separated and the injecting web rewound on takeup reel 43, and the transferred image on the copy web may be fixed and then clipped at the appropriate length by cutting means.

Figure 2:
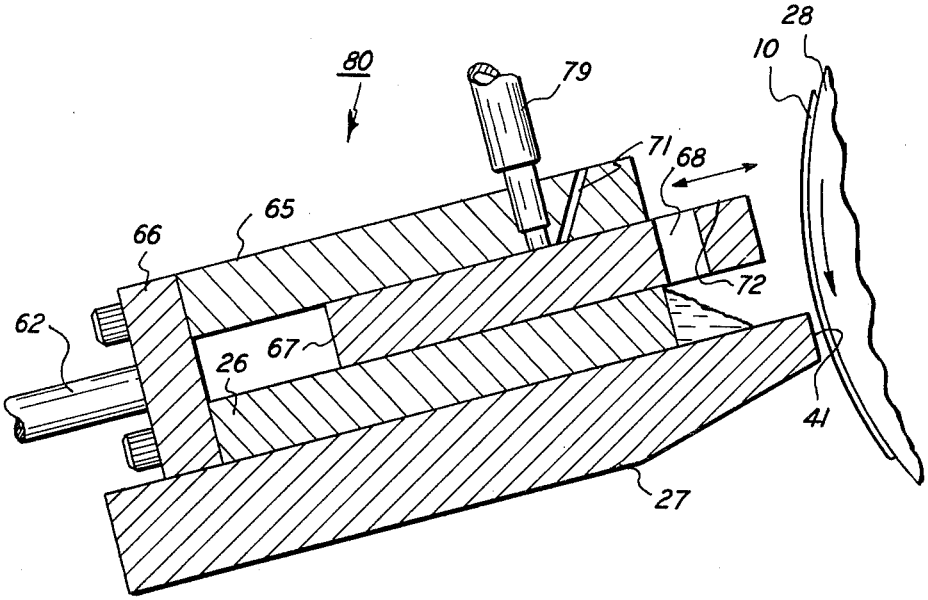
FIG. 2 is a partially schematic section view of a preferred embodiment of the pumpless coater applicator system of the present invention ready for inking application.

Referring now to FIG. 2, there is seen a partially schematic section view of the pumpless coating applicator system according to this invention ready for the inking application. The coating applicator system 80 includes the valve plate 65 attached to the applicator plate 26 by means of the clamp 66. The valve plate 65 is cammed out and back in with the applicator plate 26 and the stationary metering plate 67 is interposed between the applicator and valve plates. The valve plate 65 and applicator plate 26 are cammed by a suitable air cylinder (not shown) connected to the cam rod 62 to move the plates forward and rearward intermittently in a linear direction. The metering plate 67 contains the cavity 68 whose length is determined by the width of the area to be linked and whose volume is related to the amount of ink to be applied per cycle. When the valve and applicator plates are cammed out, the valve plate 65 provides a flow path by which the metering reservoir empties into the well formed by the coater blade 27 and applicator plate 26.

Figure 3:
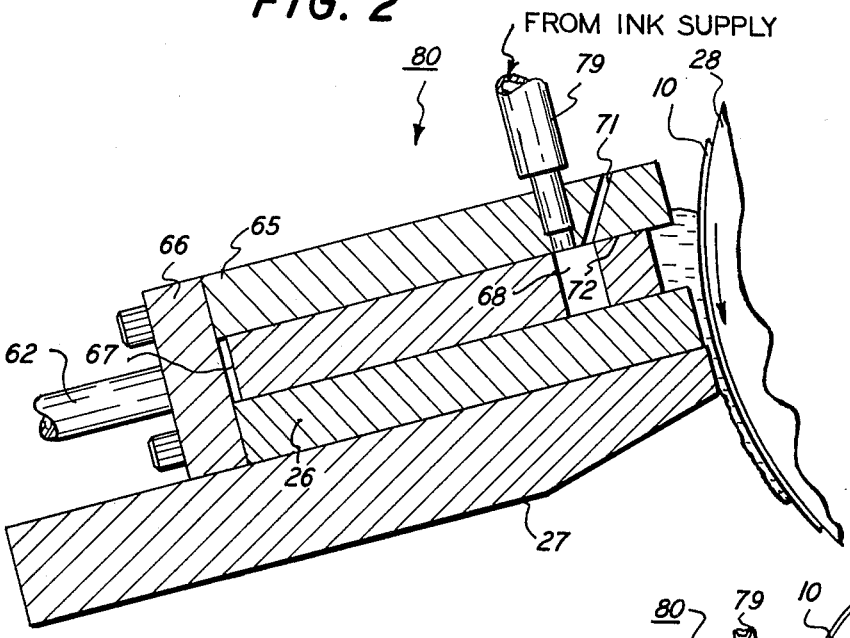
FIG. 3 is a partially schematic section view of the pumpless coater applicator system according to this invention during inking.

FIG. 3 is a partially schematic section view of the coating applicator system 80 during inking of the web 10. During the inking cycle, when the applicator plate is cammed back in, the ink is moved into the coating gap between the coater blade and inking roller 28. The valve plate 65 may be provided with air vents 71 on one end thereof. During the inking application, the air vents align with the metering reservoir 68. In an alternative mode, the air vent holes in the valve plate may be eliminated entirely by slightly undercutting the surface 72 of the metering plate 67 which interfaces with the valve plate 65 during the inking application cycle.

It is believed that one of the major causes of coating defects and resultant defects in the image is due to fibers and other materials in the ink. These fibers may become lodged on the top surface of the metering plate and protrude into the coater gap, thereby causing streaks in the applied film. Because of the surface tension, the ink tends to hold the agglomerate in place on the blade coater lip. Thus, once streaks are formed they are usually reproduced from film to film unless the coater lip is manually cleaned.

Figure 3A:
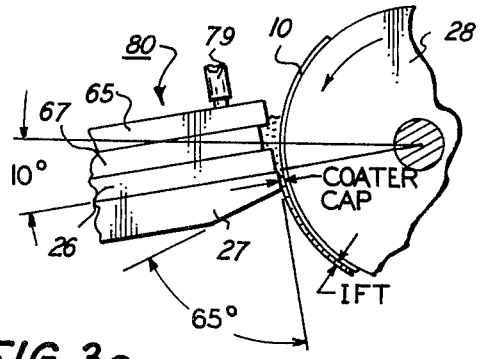
FIG. 3a is a partially schematic diagram of features which may prevent the trapping of fibers on the top edge of the applicator plate.

Referring now to FIG. 3*a*, there are shown two features of the present invention to help prevent the trapping of fibers on the top edge of the applicator plate. First, the angle of inclination of the blade coater assembly, e.g., the angle of the applicator plate 26 with respect to the inking roller 28, is reduced to about 10°. The 10° angle will reduce the gravitational forces holding the agglomerates on the upper part of the coater lip. Second, the edge of the blade coater 27 is beveled to a relief angle of about 65° to 70° in order to allow the ink agglomerates to gradually channel into the metering gap. Thus, the viscous flow forces of the ink will assist in pulling agglomerates and fibers through the coater gap. The blade coater metering lip 41, preferably, may be between 20 to 30 mils in width. When the applicator plate is cammed forward to apply metered amounts of ink into the coater gap, the final ink-film thickness (IFT) on the web 10 is in direct proportion to the width of the coater gap, i.e., the width of the coater gap determines the final applied ink film thickness.

Other modifications and variations of the inventive coating applicator system will be apparent to those skilled in the art upon reading the present specification and these are intended to be within the spirit of the invention and the scope of the claims.

What is claimed is:

1. A coating apparatus comprising in combination:

a. a coater blade base;

b. an applicator plate supported on a top surface of said coater blade base;

c. a metering plate including a metering cavity supported on a top surface of said applicator plate;

d. a valve plate supported on a top surface of said metering plate, said valve plate including means for supplying ink;

e. a backup roll mounted adjacent and in close proximity to said coater blade base; and f. means for reciprocating said applicator plate and said valve plate forward and rearward intermittently for moving ink to a top surface of said coater blade base and for moving the ink from a top surface of the coater blade base into a metering gap formed between the coater blade base and the backup roll.

2. Apparatus as defined in claim 1 wherein said valve plate further includes air vent means.

3. Apparatus as defined in claim 1 wherein the angle of inclination formed between said coater blade and said backup roll is about 10°.

4. Apparatus as defined in claim 3 wherein said coater blade front edge is beveled to a relief angle of from about 65° to about 70°.

* * * * *